US007401640B2

(12) United States Patent
Chen

(10) Patent No.: US 7,401,640 B2
(45) Date of Patent: Jul. 22, 2008

(54) DIE-CASTING MOLD CORE

(75) Inventor: Ga-Lane Chen, Santa Clara, CA (US)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/309,563

(22) Filed: Aug. 23, 2006

(65) Prior Publication Data

US 2007/0095497 A1 May 3, 2007

(30) Foreign Application Priority Data

Oct. 27, 2005 (CN) ..... 2005 1 0100787.X

(51) Int. Cl.
*B22C 9/10* (2006.01)

(52) U.S. Cl. ..... 164/369; 164/267

(58) Field of Classification Search ..... 164/369, 164/267, 72, 55.1; 420/104, 111; 428/408
See application file for complete search history.

(56) References Cited

U.S. PATENT DOCUMENTS 4,734,339 A * 3/1988 Schachner et al. ..... 428/701
6,479,013 B1 * 11/2002 Sera et al. ..... 420/69
6,669,900 B2 12/2003 Matsunaga et al.
7,160,616 B2 * 1/2007 Massler et al. ..... 428/408

* cited by examiner

*Primary Examiner*—Kevin Kerns
*Assistant Examiner*—I.-H. Lin

(57) ABSTRACT

An exemplary die-casting mold core includes a mold body, an intermediate layer and a diamond-like carbon film. The mold body is made of a steel alloy containing carbon, chromium, manganese, silicon, vanadium, and iron. A molar percentage of hydrogen in the diamond-like carbon film is in a range from 2% to 25%. The die-casting mold core has excellent mechanical hardness, good corrosion resistance, good wear resistance, long lifetime and ease of separation.

7 Claims, 2 Drawing Sheets

DIE-CASTING MOLD CORE

TECHNICAL FIELD

The present invention generally relates to a mold core and, more particularly to a mold core with a release film for die-casting.

BACKGROUND

In recent years, magnesium alloys have attracted much attention for their recyclability, low specific gravities, and good heat dissipation properties. Magnesium alloys can be substituted for plastic and steel material. For example, magnesium alloys can be used as casings for household electrical appliances, such as television receivers, notebook computers, and portable minidisk players.

Magnesium alloys are usually made into molded products using a die-casting method. Die-casting is a technique for manufacturing large quantities of casting with high precision and excellent surface texture by injecting molten metal into a precise mold at high pressure.

Generally, die-casting of magnesium alloy requires the use of a release agent to reduce the tendency of magnesium alloy product to become stuck to the mold. The release agent is usually sprayed on a molding surface of the mold. However, the release agent layer formed on the molding surface generally has a non-uniform thickness, which will cause errors in the resulting magnesium alloy products. Moreover, the release agent usually includes aliphatic hydrocarbon, carbonyl group (C═O), and silicone group (Si—O—C) compounds. These organic compositions can cause corrosion in the mold and further contaminate the resulting magnesium alloy products.

What is needed, therefore, is a die-casting mold core with excellent characteristics such as hardness, corrosion resistance, wear resistance, and ease of separation from the mold.

SUMMARY

One embodiment provides a die-casting mold core. The die-casting mold core includes a mold body, an intermediate layer and a diamond-like carbon film. The mold body is made of a steel alloy composed of carbon, chromium, manganese, silicon, vanadium, and iron, and has a molding surface. The intermediate layer is formed on the molding surface of the mold body. The diamond-like carbon film is formed on the intermediate layer. A molar percentage of hydrogen in the diamond-like carbon film is in a range from 2% to 25%.

BRIEF DESCRIPTION OF THE DRAWINGS

Many aspects of the present embodiment can be better understood with reference to the following drawings. The components in the drawings are not necessarily drawn to scale, the emphasis instead being placed upon clearly illustrating the principles of the present embodiment. Moreover, in the drawings, like reference numerals designate corresponding parts throughout the several views.

DETAILED DESCRIPTION OF PREFERRED EMBODIMENTS

Figure 1:
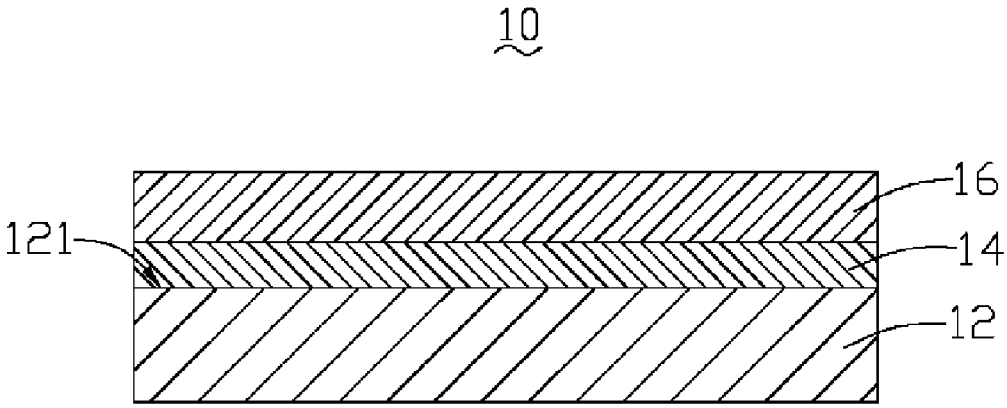
FIG. 1 is a schematic, cross-sectional view of a die-casting mold core according to a preferred embodiment.

Embodiments will now be described in detail below and with reference to the drawing.

Referring to FIG. 1, a mold core 10 according to a preferred embodiment is shown. The mold core 10 includes a mold body 12, an intermediate layer 14 and a diamond-like carbon film 16 stacked one on top of the other in that order.

The mold body 12 is usually made of a steel alloy, and preferably is made of a steel alloy containing carbon, chromium, manganese, silicon, vanadium, and iron. In this exemplary embodiment, the steel alloy contains 0.2%~0.5% by weight of carbon, 3%~15% by weight of chromium, 0.2%~0.8% by weight of manganese, 0.5%~2.0% by weight of silicon, and 0.2%~2.0% by weight of vanadium, with remainder being iron. The mold body 12 defines a molding surface 121 with a shape conforming to that of an article to be produced.

The intermediate layer 14 is formed on the molding surface 121 of the mold body 12 and sandwiched between the mold body 12 and the diamond-like carbon film 16 for improving adhesion therebetween. The intermediate layer 14 can be made of a material selected from a group consisting of chromium, titanium, chromium titanium, and chromium nitride. In the embodiment, the intermediate layer 14 is a chromium film. The intermediate layer 14 has a thickness in a range from 2 nanometers to 30 nanometers. Preferably, the intermediate layer 14 has a thickness in a range from 5 nanometers to 20 nanometers.

The diamond-like carbon film 16 is formed on the intermediate layer 14. The diamond-like carbon film 16 serves as a mold release layer, due to its high mechanical hardness, good smoothness, low reactivity, smoothness, and wear resistance.

The diamond-like carbon film 16 is a hydrogenated amorphous carbon film containing hydrogen. The content of hydrogen affects the properties of the diamond-like carbon film 16.

On one hand, hydrogen in diamond-like carbon films enhances mechanical performance and corrosion resistance of the diamond-like carbon film. For example, when the molar percentage of hydrogen in the diamond-like carbon film 16 reaches 2% or more, the diamond-like carbon film 16 gains an improved mechanical performance and corrosion resistance because hydrogen fills the dangling bond in the diamond-like carbon film.

On the other hand, when the molar percentage of hydrogen in the diamond-like carbon film 16 is increased to more than 25%, hydrogen released from the diamond-like carbon film 16 at high temperature affects quality of magnesium alloy products. During die-casting of magnesium alloy, the temperature usually can be in a range between 250 degrees Celsius and 300 degrees Celsius. The desired molar percentage of hydrogen in the diamond-like carbon film 16 should be equal to or less than 25% in order to ensure that the diamond-like carbon film 16 has a good tolerance for high temperature.

In the embodiment, the molar percentage of hydrogen in the diamond-like carbon film 16 is in a range from 2% to 25%. The diamond-like carbon film 16 having hydrogen content in this particular range has good mechanical hardness, corrosion resistance and wear resistance, whilst the diamond-like carbon film 16 has tolerance for high temperature. Preferably, the molar percentage of hydrogen in the diamond-like carbon film 16 should be in a range from 5% to 15%.

The diamond-like carbon film 16 has a thickness in a range from 100 nanometers to 2000 nanometers. Preferably, the diamond-like carbon film 16 has a thickness in a range from 500 nanometers to 1000 nanometers.

Figure 2:
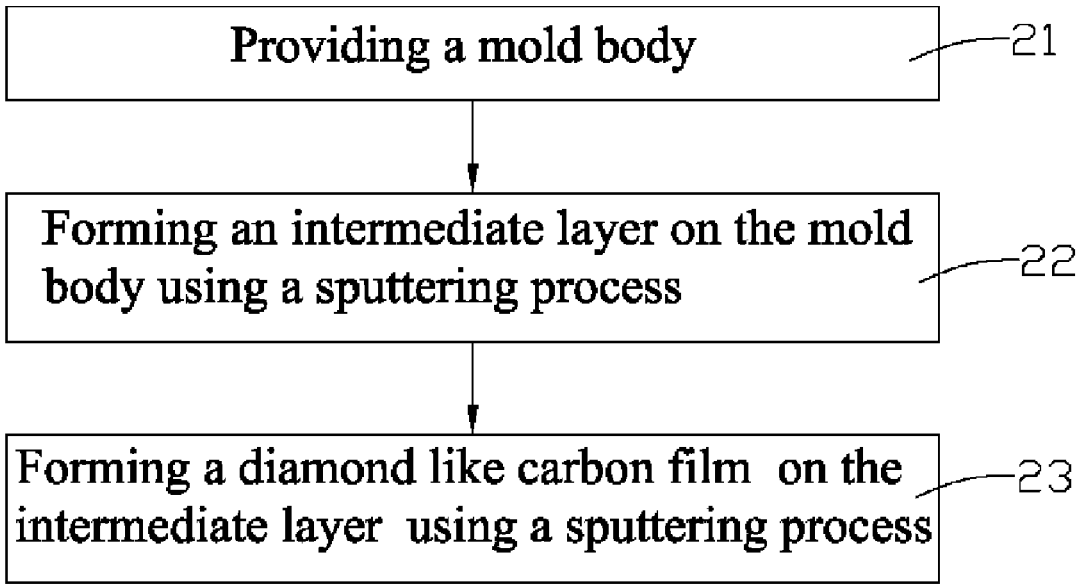
FIG. 2 is a flow chart of a method for manufacturing a die-casting mold core according to a preferred embodiment.

Referring to FIG. 2, a method for manufacturing the die-casting mold core 10 according to a preferred embodiment is shown. The method includes steps of:

step 21: providing a mold body 12;

step 22: forming an intermediate layer 14 on the molding surface 121 of the mold body 12 using a sputtering process; and step 23: forming a diamond-like carbon film 16 on the intermediate layer 14 using a sputtering process.

The following embodiment is provided to describe the method for manufacturing the die-casting mold core 10 in detail.

In the step 21, a mold body 12 is provided. As mentioned above, the mold body 12 is usually made of a steel alloy composed of carbon, chromium, manganese, silicon, vanadium, and iron. The steel alloy contains 0.2%~0.5% by weight of carbon, 3%~15% by weight of chromium, 0.2%~0.8% by weight of manganese, 0.5%~2.0% by weight of silicon, and 0.2%~2.0% by weight of vanadium, with remainder being iron.

In the step 22, an intermediate layer 14 is formed on the molding surface 121 of the mold body 12. The intermediate layer 14 serves as an adhesive layer to enhance the adhesion between the mold body 12 and the diamond-like carbon film 16. The intermediate layer 14 is deposited by a method selected from a group consisting of direct current magnetron sputtering, alternating current magnetron sputtering, and radio frequency magnetron sputtering. In the embodiment, the intermediate layer 20 is a chromium metal film. The chromium metal film is deposited using radio frequency magnetron sputtering. The chromium metal film has a thickness in a range from 2 nanometers to 30 nanometers. Preferably, the chromium metal film has a thickness in a range from 5 nanometers to 20 nanometers.

In the step 23, a diamond-like carbon film 16 is formed on the intermediate layer 14. The diamond-like carbon film 16 is deposited using a method selected from a group consisting of direct current magnetron sputtering, alternating current magnetron sputtering, radio frequency magnetron sputtering or chemical vapor deposition.

In the preferred embodiment, the diamond-like carbon film 16 is deposited using radio frequency magnetron sputtering. During the sputtering process, the diamond-like carbon film 16 is deposited on the intermediate layer 14 in vacuum environment. The target is a carbon target. The sputter gas is a mixture of gas A and gas B. Gas A is selected from a group consisting of argon and krypton, and gas B is a gas containing hydrogen such as methane, ethane, and hydrogen. A molar percentage of hydrogen in the mixture is in a range from 2% to 25%. Because the content of hydrogen is related to the gas B, it can be adjusted by the ration of gas B in the mixture. Thus, the diamond-like carbon film 16 having a desired molar percentage of hydrogen can be obtained. For example, when the sputter gas is a mixture of argon and methane and the molar percentage of hydrogen in the mixture is in a range from 2% to 25%, the molar percentage of hydrogen in the diamond-like carbon film 16 should also be in a range from 2% to 25%.

During radio frequency magnetron sputtering, the target and cathode are connected with a matching network. Due to inductors and capacitors within the matching network, the power supplied by the radio frequency power supply can be tuned and maximized so that the reflecting power is minimized. In the preferred embodiment, the radio frequency power supply has a frequency at about 13.56 megahertz (MHZ).

Additionally, a direct current bias, alternating current bias or radio frequency bias may be applied to the mold body 12.

The diamond-like carbon film 16 deposited has a thickness in a range from 100 nanometers to 2000 nanometers. Preferably, the diamond-like carbon film 16 has a thickness in a range from 500 nanometers to 1000 nanometers.

The mold core 10 made by means of the above-described method has excellent mechanical hardness, corrosion resistance and wear resistance, chemical stability, longer lifetime and ease of separation.

While certain embodiments of the present invention have been described and exemplified above, various other embodiments will be apparent to those skilled in the art from the foregoing disclosure. The present invention is, therefore, not limited to the particular embodiments described and exemplified but is capable of considerable variation and modification without departure from the scope of the appended claims.

What is claimed is:

1. A die-casting mold core, comprising:

a mold body made of a steel alloy composed of carbon, chromium, manganese, silicon, vanadium, and iron, the mold body having a molding surface;

an intermediate layer formed directly on the molding surface of the mold body, the intermediate layer being comprised of a material selected from a group consisting of chromium, titanium, chromium titanium, and chromium nitride; and a diamond-like carbon film formed directly on the intermediate layer, a molar percentage of hydrogen in the diamond-like carbon film being in a range from 2% to 25%.

2. The die-casting mold core as claimed in claim 1, wherein the steel alloy of the mold body comprises 0.2%~0.5% by weight of carbon, 3%~15% by weight of chromium, 0.2% and 0.8% by weight of manganese, 0.5%~2.0% by weight of silicon, 0.2%~2.0% by weight of vanadium, with remainder being iron.

3. The die-casting mold core as claimed in claim 1, wherein the percentage of hydrogen in the diamond-like carbon film is in a range from 5% to 15%.

4. The die-casting mold core as claimed in claim 1, wherein a thickness of the diamond-like carbon film is in a range from 100 nanometers to 2000 nanometers.

5. The die-casting mold core as claimed in claim 4 wherein the thickness of the diamond-like carbon film is in a range from 500 nanometers to 1000 nanometers.

6. The die-casting mold core as claimed in claim 1, wherein the intermediate layer has a thickness in a range from 2 nanometers to 30 nanometers.

7. The die-casting mold core as claimed in claim 6, wherein the intermediate layer has a thickness in a range from 5 nanometers to 20 nanometers.

* * * * *